United States Patent [19]

Wesner

[11] 4,310,107

[45] Jan. 12, 1982

[54] MANUALLY OPERATED, TRIGGER ACTUATED DIAPHRAGM PUMP DISPENSER

[75] Inventor: Walter H. Wesner, Ft. Lauderdale, Fla.

[73] Assignee: The AFA Corporation, Hialeah, Fla.

[21] Appl. No.: 125,611

[22] Filed: Feb. 28, 1980

Related U.S. Application Data

[63] Continuation of Ser. No. 796,116, May 11, 1977, abandoned, which is a continuation of Ser. No. 626,818, Oct. 29, 1975, abandoned.

[51] Int. Cl.[3] ..... B05B 9/043

[52] U.S. Cl. ..... 222/214; 222/380; 417/479; 417/560; 137/512

[58] Field of Search ..... 222/207, 209, 214, 380, 222/383; 417/479, 560

[56] References Cited

U.S. PATENT DOCUMENTS

| | | | |
|---|---|---|---|
| 1,656,911 | 1/1928 | Eisenhauer | 417/560 |
| 2,065,541 | 12/1936 | Shaffer et al. | 417/560 X |
| 2,980,032 | 4/1961 | Schneider | 417/479 |
| 3,685,739 | 8/1972 | Vanier | 239/333 |
| 3,749,290 | 7/1973 | Micallef | 222/207 |

FOREIGN PATENT DOCUMENTS

| | | | |
|---|---|---|---|
| 39289 | 8/1973 | Australia | 222/207 |

*Primary Examiner*—Robert J. Spar
*Assistant Examiner*—Frederick R. Handren
*Attorney, Agent, or Firm*—Arthur H. Swanson

[57] ABSTRACT

A manually operated dispensing device for a container holding a quantity of liquid is disclosed. The device has an internal chamber and a flexible, elastomeric diaphragm-like cover on at least one side of the chamber in a component retaining body. Associated inlet and outlet valves, which valves may be discrete or integral with the diaphragm and body, and conduits are included whereby liquid from a supply thereof in the container is drawn up into the chamber when the diaphragm is flexed under stress. The diaphragm is operatively associated with a trigger device, the actuation of which flexes and stresses the diaphragm in a direction to decrease the chamber volume. Liquid which is present in the chamber is displaced and pressurized in a pumping action, forcing the outlet or discharge valve to open and the inlet valve to close allowing the liquid to flow into the outlet or discharge conduit and be dispensed from the device. Alternate application and relief of the above described flexing or stressing action of the diaphragm by alternate actuation and release of the trigger causes the inlet and outlet valves to alternately open and close, and liquid to be drawn into the chamber and be dispensed therefrom.

6 Claims, 5 Drawing Figures

MANUALLY OPERATED, TRIGGER ACTUATED DIAPHRAGM PUMP DISPENSER

This is a continuation of application Ser. No. 796,116, filed May 11, 1977, abandoned, which is a continuation of Ser. No. 626,818, filed Oct. 29, 1975, now abandoned.

BACKGROUND OF THE INVENTION

Manually operated, trigger actuated dispensing pumps for liquid containers have been proposed in the past, a particular one having wide commercial acceptance and application being disclosed in U.S. Pat. No. 3,061,202, granted Oct. 30, 1962 to Tracy B. Tyler. This type of pump while finding wide spread commercial use is relatively expensive to manufacture being comprised of many different parts, each requiring in and of themselves relatively costly methods to manufacture and/or assemble and also being relatively complex and having relatively high cost materials associated therewith.

Other prior art patents have been granted which overcome in some measure the problem of the above cited U.S. Pat. No. 3,661,202, a particular one being U.S. Pat. No. 3,749,290, granted Oct. 31, 1973, to Lewis A. Micallef et al. This patent discloses a trigger sprayer having a deformable, hollow elastomeric tube internally supported in a body. The tube is compressively stressed on a sidewall thereof by a trigger mechanism to thereby reduce its internal volume and, as a result, liquid drawn thereinto from a container, is dispensed. The tubular member incorporates axially aligned, inlet and outlet ports in the bottom and top respectively of the device, together with associated inlet and outlet valving, the former being in the open bottom and the latter being in the upper part of the tubular member which is adapted to engage part of the sprayer body to form the valve. The Micallef et al. device uses a trigger to depress the sidewall of its tubular member which in turn, causes the inlet valve to close and the outlet valve to open to dispense liquid, the amount of liquid dispensed in a single actuation of the trigger being determined by the amount of sidewall movement or flexing. The Micallef device is an example of a low cost, collapsible container, non-aerosol dispenser.

U.S. Pat. No. 3,486,663 to F. H. Humphrey, granted on Dec. 30, 1969, discloses a dispenser comprising an elastomeric pump and check valve. The pump consists of an elastomeric member having a recessed portion adapted for sealing engagement with a supporting surface to define therewith a closed chamber. Also incorporated in the device are one or more internal partitions which form one or more compartments. Associated inlets and outlets are incorporated therein together with an ejection orifice. Liquid is drawn up into one or more of the compartments by the flexing of the outer wall of the pump by the finger or thumb and thereafter ejected by succeeding flexing actuations thereof.

Other types of sprayers are well-known to the art and come to mind when it is desired to spray liquids from a container. For example, a finger actuated plunger sprayer has long been available and widely used. The art is well developed with many dispensing devices proposed and manufactured for manual actuation, including trigger actuators.

SUMMARY OF THE INVENTION

This invention has as its principal object the construction and assembly of an extremely inexpensive, manually operated, trigger actuated pumping dispenser for a liquid container which is constructed with few parts, each part individually simple and inexpensive to manufacture and assemble, and made of materials which are readily available and also inexpensive.

Another object of the invention is to provide a liquid dispenser of the foregoing type wherein the liquid is dispensed from a container upon which the device is mounted and wherein a discharge valve is incorporated as an integral part of the pumping mechanism in the form of a flexible diaphragm, the flexing of which varies a chamber volume to eject liquid from a nozzle carried by the device in a spray, if desired.

Still another object of the present invention is to provide a dispenser of the foregoing type having a component retaining body and wherein most or all of the components, in particular, the diaphragm are comprised and manufactured of low cost, thermoplastic materials.

A further object of this invention is to provide a manually operated dispensing device of the foregoing type wherein inlet and outlet valves, operatively associated with the pump mechanism, are housed in the body in a simple manner in a single, moving part of simple construction.

An additional object of the invention is to provide a dispensing device of the type referred to wherein the inlet and outlet valves are discretely and separately retained in the body and operatively associated with the diaphragm, each valve being contained in separate inlet and outlet passages connected to a pump chamber in the dispenser.

DESCRIPTION OF THE PREFERRED EMBODIMENTS

Figure 1:
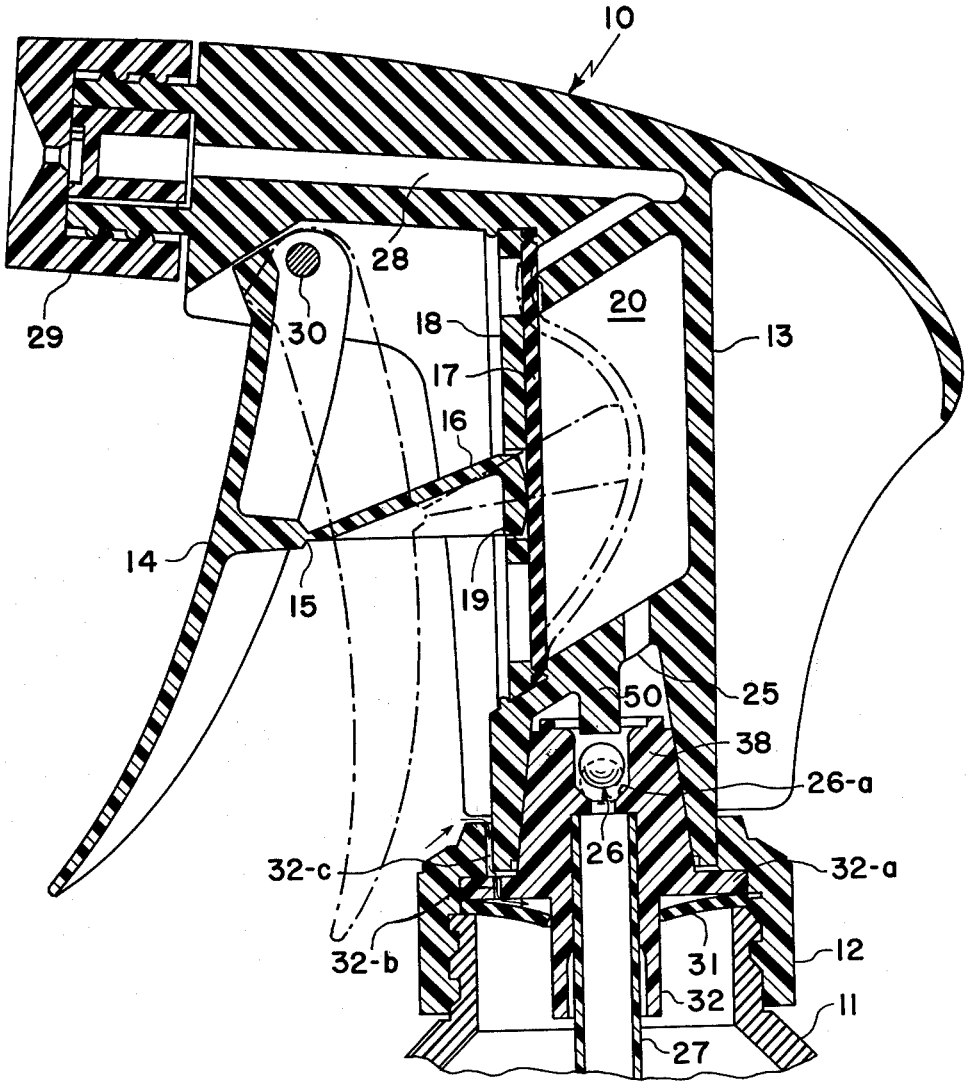
FIG. 1 is a vertical transverse section of a preferred embodiment of the invention.
Figure 2:
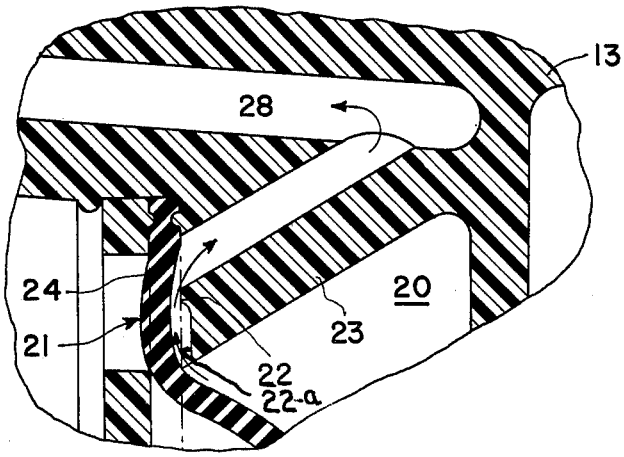
FIG. 2 is a sectional view of a portion of the invention of FIG. 1 on a magnified scale.

Describing now the structure of the presently illustrated preferred embodiment of the invention, as set forth in FIGS. 1 and 2, said invention comprises a dispenser 10 secured to a container 11 by means of a base closure or cap 12 on the neck of container 11. Dispenser 10 comprises a component retaining body 13, an operating member or trigger 14 including an extension 16 connected thereto by a plastic hinge 15. Extension 16 operatively contacts, through the medium of its plunger-like end, a resiliently deformable, flexible pump diaphragm 17 which is retained in body 13 by a press-fitted retaining plate 18. Plate 18 is perforated and has a central hole 19 through which extension 16 and its plunger pass permitting the latter to contact in engagement with diaphragm 17. An open cavity is formed in body 13 defining a generally cylindrical chamber 20 for receiving liquid to be dispensed. A top section or upper wall 23 of chamber 20 contains or includes an outlet valve 21 (See FIG. 2), the end surface thereof having a vertical groove 22-*a* terminating just short of a sealing surface or valve seat 22 juxtaposed in sealing relation with a upper portion 24 of diaphragm 17. An inlet conduit 25 leading from an inlet valve 26 connects the interior of chamber 20 with a supply tube 27 in container 11. Valve 26 comprises a valve element 26-*a* positioned in a valve seat formed in a tube support or insert 38 in body 13 above supply tube 27. Supply tube 27 communicates with the interior of container 11 and provides means for conducting liquid drawn from container 11 into chamber 20. An outlet conduit 28 connects chamber 20 through outlet valve 21 to a discharge nozzle 29 for dispensing liquid.

Trigger 14 is pivotally supported on body 13 pivoting about a pin connector 30 to facilitate flexing actuation of diaphragm 17.

Dispenser 10, as above mentioned, is attached to container 11 by closure or base cap 12, and is provided with means for venting container 11 to insure equalization of pressure therein. The venting means comprises a thin, annular, flexible, washer-like membrane or ring seal 31 which is clamped on the top of container 11 under a flange 32-*a* of insert 38 by cap 12. Ring seal 31 has a central aperture and sealingly contacts the circular, outer surface 32 of insert or tube support 38 in the lower end of body 13, and flexes downwardly when air pressure above is higher than pressure below. In other words, if a negative pressure developes in container 11 due to liquid withdrawal, ring seal 31 will deform by flexing downwardly and separate from surface 32. Air from outside flows through a vent passage 32-*c* provided between cap 12 and body 13, through the slot 32-*b* in flange 32-*a*, around or between surface 32 and ring seal 31 in the central aperture thereof and into container 11 to replace the liquid drawn up into chamber 20.

In FIG. 2, as mentioned above, outlet valve 21 is shown on a magnified scale, in the open or liquid discharging condition, diaphragm portion 24 of flexible diaphragm 17 being separated from valve seat 22 to open valve 21 permitting liquid in chamber 20 to pass into conduit 28. As diaphragm 17 is flexed by actuation of trigger extension 16 thereagainst, which builds liquid pressure in chamber 20, valve portion 24 of diaphragm 17 separates from valve seat 22. Liquid flow communication is thereby established between chamber 20 interior and exit conduit 28 and subsequent liquid ejection from nozzle 29.

Figure 3:
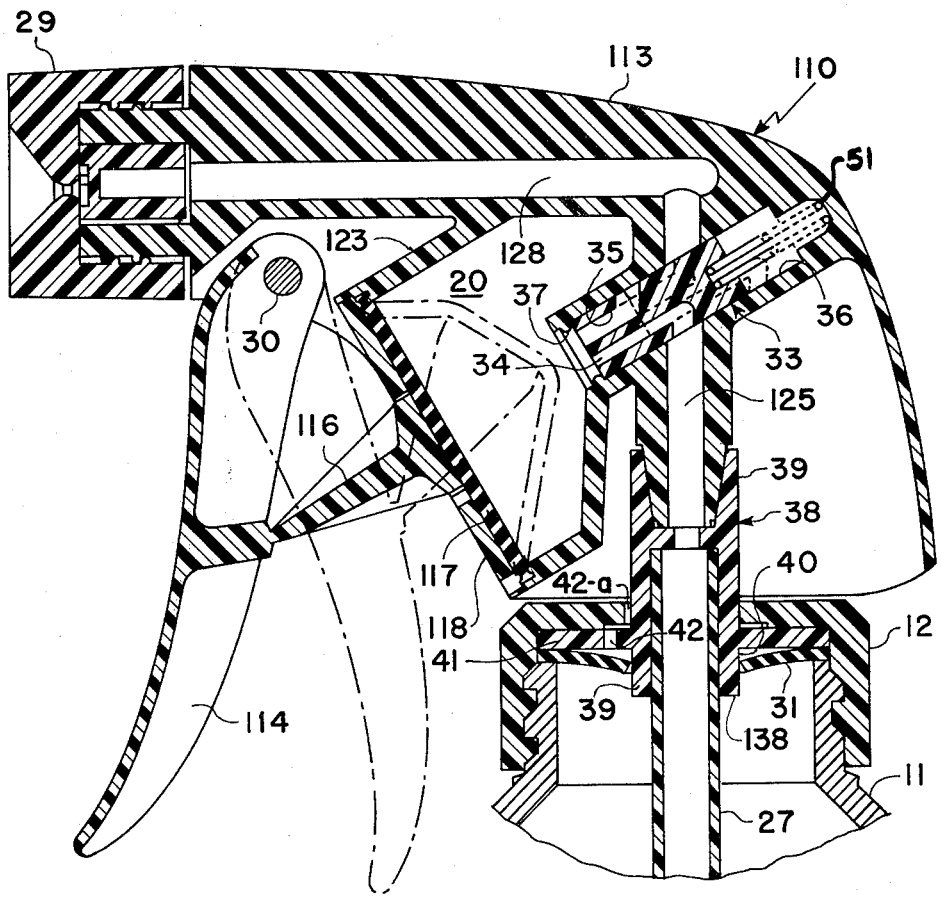
FIG. 3 is a vertical transverse section of another embodiment of the invention illustrating the single part, inlet and outlet valve thereof.

Referring now to FIG. 3, another embodiment of the invention is illustrated comprising a sprayer 110 having a pump diaphragm 117 in a body 113. A chamber 120 having substantially cylindrical walls 123 is also formed in body 113. An inlet conduit 125 communicates with chamber 120 through a composite, movable valve element 33 by means of an inlet passage 34 therein, and an outlet conduit 128 also communicates with chamber 120 by means of an outlet passage 35, also in element 33. Valve element 33 is slidably movable between two positions in a valve bore 36 in body 113, being retained therein by a circumferential lip or retaining ring 37 in bore 36 near the entrance to chamber 120 and by a compression spring 51. In its normal position valve element 33 contacts ring 37 and inlet passage 34 therein is aligned with inlet conduit 125, diaphragm 117 is in its unflexed condition and outlet passage 35 is closed with respect to outlet conduit 128. As will be more fully explained in the decription of the operation of the invention, outlet passage 35 is larger in cross-sectional area than passage 34, and valve element 33 is slidably movable in bore 36 between two positions, being urged to the right when pressure in chamber 120 is increased by flexing of diaphragm 117.

Dispenser 110 is mounted on container 11 by threaded closure 12, as in the previous embodiment, and venting thereof is provided by apertured ring seal 31, also as previously described. However, in this instance, an insert 138 is utilized comprising a vertically extending tube support 39 which has on its lower end, a circular sealing surface 40. A radially extending flange 41 on insert 138 has a vent passage 42 which is in communication with a similar passage 42-*a* in cap 12 permitting air to flow into container 11 when ring 31 is flexed downwardly separating from surface 40.

Figure 4:
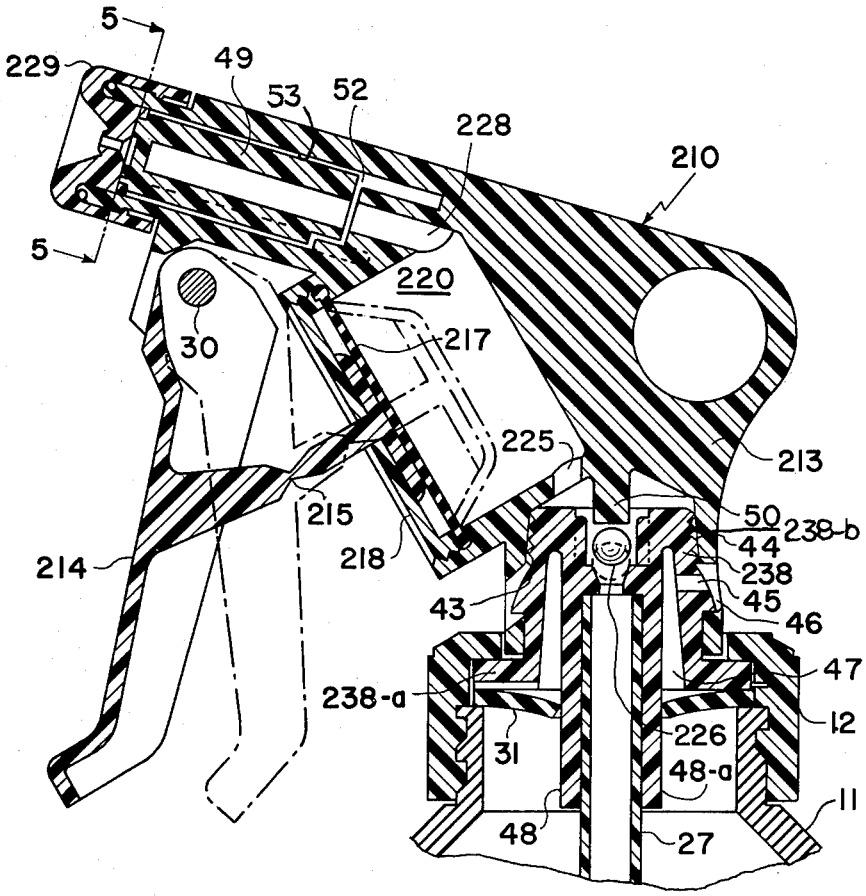
FIG. 4 is a vertical transverse section of still another embodiment of the invention; and, FIG. 5 is a view substantially along lines 5—5 of FIG. 4.

In FIG. 4 still another embodiment of the invention is disclosed wherein a diaphragm 217 is supported in a body 213 of a dispenser 210 covering the opening of an internal chamber 220 therein. An inlet conduit 225 leads from an inlet valve 226, the valve shown being a ball check similar to valve 26 of FIG. 1. Venting of container 11 is again provided by washer-like, apertured ring seal 31, which is carried on the top of container 11 being clamped thereon between a flange 238-*a* on an intake insert 238 which is pressed by snapping the same into a recess 43 in body 213. Insert 238 maintains a fluid tight seal created by serrations or ribs 44 against the internal surface 238-*b* of recess 43. A passage 45 in insert 238 aligned with a slot 46 in body 213 permits air to flow into an annular chamber 47 where, should a negative pressure develope in container 11, it acts on ring seal 31 flexing it downwardly away from a sealing surface 48-*a* on a tube support 48 of insert 238.

A movable outlet, discharge valve or spin element 49 is mounted in body 213 in a nozzle chamber 53 thereof being slidably movable therein between two positions between the end of an outlet or discharge conduit 228 and the entrance to a discharge nozzle 229 on body 213. In one position adjacent and abutting the entrance to nozzle 229 in FIG. 4 valve 49 is open, and in another, opposite position, adjacent and abutting the end of outlet conduit 228, valve 49 is closed, being moved to these positions in response to flexing and unflexing of a diaphragm 217, as will be explained, when actuated by a trigger 214 through an extension 216 thereon. The flexing and unflexing i.e., pumping action, of diaphragm 217 also opens and closes inlet valve 226, the upward movement thereof being limited by a projection 50 of body 213 extending downwardly to a position above valve 226.

Figure 5:
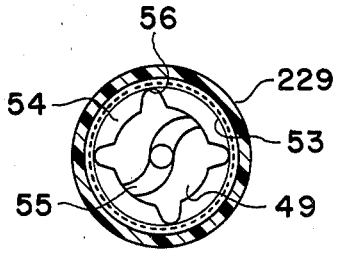

In FIG. 5, valve or spin element 49 is formed with outer projections or shoulders 56 which slidably contact the inner walls of chamber 53 and cooperate therewith to provide liquid passages 54. Liquid passages 54 terminate in radial passages 55 which connect with nozzle 229 for liquid ejection.

OPERATION OF THE PREFERRED EMBODIMENTS

In operation of the preferred embodiment of the present invention, dispenser 10 in FIG. 1 is mounted on container 11 by threading closure or cap 12 on to the threaded neck of container 11 clamping apertured ring seal 31 therebetween. To operate the invention, the assembled dispenser 10 is held in the hand, fingers grasping trigger 14, cap 12 against the palm of the hand with the container 11 extending therebelow. Trigger 14 is actuated by a squeezing action, which forces trigger extension 16 against diaphragm 17 flexing it inwardly to decrease the volume of chamber 20 into which it extends. At the same time, as shown in FIG. 2, valve 21 in the upper end of chamber 20 opens by the flexing of diaphragm 17 and valve portion 24 thereof, separating the latter from seat 22 which permits fluid to pass into outlet or discharge conduit 28 and out of dispenser 10 being ejected from nozzle 29. Fluid pressure rise in chamber 20, caused by flexing of pump diaphragm 17 forces the ball of valve 26 against its seat **26-*a* closing it. In FIG. 1, the broken lines indicate the position of the various parts in pumping and flexing of diaphragm 17. When squeezing pressure on trigger 14 is relieved, trigger 14 is moved to its normal position, pivoting on pin 30, being moved thereto by diaphragm 17 inherent memory or resistance to deformation, a characteristic of elastomeric materials of which it is made and diaphragm 17 returns to its original shape. Return of diaphragm 17 expands chamber 20 creating a slight vacuum therein and inlet valve 26 opens. Simultaneously, diaphragm 17, valve portion 24 reseats on seal surface 22 and valve 21 closes, and liquid is drawn into chamber 20 from container 11 through supply tube 27, open inlet valve 26 and conduit 25. Subsequent actuation of trigger 14 decreases the volume of chamber 20, forces valve 21 to open, valve 26 to close and liquid to flow into outlet passage 28 and be dispensed from dispenser 10 through nozzle 29**.

In operation of the embodiment of FIG. 3, actuation of trigger 114 forces diaphragm 117 to flex into chamber 120 decreasing its volume. Fluid pressure in chamber 120 rises and forces movable composite valve element 33 rearwardly in bore 36 compressing spring 51 until it reaches the position shown by the broken lines in FIG. 3. Composite valve element 33 moves rearwardly because inlet passage 34 is smaller in cross-sectional area than outlet passage 35 being of a size too small to transmit liquid back therethrough toward inlet conduit 125 as rapidly as pressure builds in chamber 120, hence a net force developes and acts on element 33 moving it rearwardly against spring 51. In this position, internal outlet passage 35 is aligned with discharge conduit 128 and liquid flows from chamber 120 into conduit 128 and is ejected from nozzle 29, as in the previously described embodiment of FIG. 1, and inlet passage 34 moves out of alignment with inlet conduit 125, in bore 36 preventing liquid flow thereinto.

When actuation pressure on trigger 114 is removed, diaphragm 117 returns to its original shape due to its elastic memory and urges trigger 114 to its original position as shown in solid lines in FIG. 3. The broken lines in FIG. 3, illustrate the positions of the various parts when trigger 114 is actuated to pump liquid from dispenser 110. FIG. 3 also is illustrative of a bifunctional valve system, wherein single, movable element 33 provides for both inlet and outlet valving.

Operation of the additional embodiment of FIG. 4, wherein a different valve system is illustrated, will now be described. In dispenser 210, diaphragm 217 is flexed by trigger 214, as in the previously described embodiments and as indicated by the broken lines. Simultaneously chamber 220, into which diaphragm 217 is flexed, is pressurized and its volume decreased. Inlet valve 226 closes preventing flow of fluid back into container 11, while at the same time, fluid under pressure in chamber 220 flows into outlet or discharge conduit 228 and forces element 49 to move forwardly on shoulders 56 in nozzle chamber 53 until it contacts and abuts the entrance to nozzle 229. Liquid then passes through a passage 52 at the end of conduit 228 into passages 54, radial passages 55 and out through nozzle 229. When pressure on trigger 214 is relieved, diaphragm 217 returns to its original shape due to its resiliency and inherent elastic memory and causes trigger 214 to return to its original or initial position. As diaphragm 217 assumes its original, i.e., unstressed condition, the volume of chamber 220 is increased and a slight vacuum is created therein. As a result, inlet valve 226 is unseated and opens, outlet valve 49 closes off passage 52 by returning to a position abutting the exit end of outlet conduit 228 and liquid is drawn up into chamber 220 from container 11 through dip tube 27 therein.

What has therefore been described and illustrated as an advancement in the art of trigger actuated sprayers and dispensers and the like, is an elastomeric, deformable, as by stretching and the like, member or diaphragm covering a dispenser pump chamber. The member is flexed by a trigger actuator to decrease the volume of the pumping chamber and liquid is pumped from the dispenser in the form of a spray. The diaphragm is preferably made from highly flexible materials such as rubber, natural and synthetic, as well as other synthetics such as polyolefin, polyurethane, polyvinyl chloride and other well-known thermoplastic materials having the necessary elastic properties and memory.

Means is also provided to insure that the liquid supply container is properly vented and that liquid therein prevented from leaking. For example, in each embodiment of the invention, as shown in FIGS. 1, 3 and 4, it can be seen that if flexible ring seal 31 is pressurized from the container side it will move by flexing outwardly against the respective circular sealing surfaces thereby insuring prevention of liquid escape from the container.

Trigger actuation results in alternate application and removal or relief of a tensile stress on the diaphragm. The invention utilizes elastomeric materials since their high degree of elasticity and natural tendency because of their inherent memory to regain their original shape after a stress is removed, is highly desirable in carrying out the present invention. Accordingly, the present invention is believed to be an important advance in the dispensing arts in the form of an inexpensive, easily operated, efficient and highly useful device of simple construction and few parts, also of low cost.

What is claimed is:

1. A manually operated dispenser adapted to be attached to a liquid container comprising:

(a) component retaining body means having an open walled cavity defining a pump chamber;

(b) a resiliently deformable pump diaphragm having an elastic memory retained in sealing relation in the cavity opening providing a sealable cover for said chamber;

(c) perforated plate means in the body means for retaining said diaphragm in the cavity opening;

(d) operating means including a pivotable trigger carried on said body means for deforming said diaphragm and varying the volume of said chamber;

(e) extension means associated with said operating means by a hinge connected to said trigger extending through said plate means in operative engagement with said diaphragm for deforming said diaphragm from a normal, undeformed nonpumping condition to a deformed, pumping condition;

(f) inlet and outlet conduit means in said component retaining body means for respectively delivering liquid into and discharging liquid out of said pump chamber;

(g) a shiftable, composite valve element in said body means;

(h) inlet and outlet valve means in said body means associated with said inlet and outlet conduit means respectively, said inlet valve means controlling delivery of liquid into said pump chamber and said outlet valve means controlling discharge of liquid from said pump chamber, said inlet and outlet valve means included in said composite valve element, said element being shiftable between at least two positions and having at least two flow passages, one of said passages registering with and providing liquid communication between said inlet conduit means and said pump chamber when said element is shifted to one of said element positions and another of said passages registering with and providing liquid communication between said outlet conduit means and said pump chamber when said element is shifted to another of said element positions; and, (i) discharge means communicating with said outlet conduit means for dispensing liquid pumped by said pump diaphragm.

2. A dispenser according to claim 1 in which one of said flow passages is smaller in cross section than the other of said flow passages.

3. A dispenser according to claim 2 in which the smaller cross section flow passage registers with the inlet conduit means.

4. A manually operating dispenser adapted to be attached to a liquid container comprising:

(a) component retaining body means having a pump chamber;

(b) a pump mechanism in said body means;

(c) operating means including a pivotable trigger carried on said body operatively associated with said pump mechanism;

(d) inlet and outlet conduit means in said body means communicating with said chamber for delivering liquid into and discharging liquid out of said chamber respectively;

(e) shiftable, composite valve element means in said body means;

(f) inlet and outlet valve means in said body means associated with said inlet and outlet conduit means respectively, said inlet valve means controlling delivery of liquid into said chamber and said outlet valve means controlling discharge of liquid from said chamber, said inlet and outlet valve means included in said composite valve element means, said element means being shiftable between at least two positions and having at least two flow passages, one of said passages registering with and providing liquid communication between said inlet conduit means and said chamber when said element means is shifted to one of its positions and another of said passages registering with and providing liquid communication between said outlet conduit means and said pump chamber when said element means is shifted to another of its positions; and, (g) discharge means communicating with said outlet conduit means for dispensing liquid pumped from said chamber by said pump mechanism.

5. A dispenser according to claim 4 in which one of said flow passages is smaller in cross section than the other of said flow passages.

6. A dispenser according to claim 5 in which said smaller cross section flow passage registers with said inlet conduit means.

* * * * *